US007195457B2

(12) United States Patent
Hou

(10) Patent No.: US 7,195,457 B2
(45) Date of Patent: Mar. 27, 2007

(54) MOTOR-OPERATED FAN FOR AIR CUSHION TABLE

(76) Inventor: Chin-Jung Hou, 19, Tai Yi 7 St. I, Jia Vill., Ren Da Hsiang, Tainan Hsien (TW)

( * ) Notice: Subject to any disclaimer, the term of this patent is extended or adjusted under 35 U.S.C. 154(b) by 190 days.

(21) Appl. No.: 11/006,795

(22) Filed: Dec. 7, 2004

(65) Prior Publication Data

US 2006/0120867 A1 Jun. 8, 2006

(51) Int. Cl.
*F03B 11/02* (2006.01)

(52) U.S. Cl. ..... 415/214.1; 415/220; 416/178; 416/187

(58) Field of Classification Search ..... 415/99, 415/101, 108, 204, 213.1, 214.1, 220, 223, 415/224; 416/178, 181, 183, 184, 187, 203, 416/200 R See application file for complete search history.

(56) References Cited

U.S. PATENT DOCUMENTS

| | | | | |
|---|---|---|---|---|
| 2,104,233 | A * | 1/1938 | Leinweber | 416/175 |
| 2,850,228 | A * | 9/1958 | Rowley | 417/411 |
| 2006/0051203 | A1* | 3/2006 | Lee et al. | 415/204 |

FOREIGN PATENT DOCUMENTS

JP 52016010 A * 2/1977

* cited by examiner

*Primary Examiner*—Edward K. Look
*Assistant Examiner*—Dwayne J White
(74) *Attorney, Agent, or Firm*—Alan D. Kamrath; Nikolai & Mersereau, P.A.

(57) ABSTRACT

A motor-operated fan includes a housing, a motor secured in the housing, and an impeller rotatably mounted on the housing and rotated by the motor. Thus, the impeller has a plurality of blades and a plurality of auxiliary blades to produce a larger air flow when the impeller is rotated so as to push a ball located above the air cushion table, so that the ball is moved above the air cushion table in an irregular manner at a higher speed, thereby providing an amusement playing effect for players.

14 Claims, 3 Drawing Sheets

MOTOR-OPERATED FAN FOR AIR CUSHION TABLE

BACKGROUND OF THE INVENTION

1. Field of the Invention

The present invention relates to a motor-operated fan, and more particularly to a motor-operated fan for an air cushion table to provide an amusement effect for players.

2. Description of the Related Art

A conventional motor-operated fan for an air cushion table comprises a motor, and an impeller. Thus, when the motor is operated, the rotation shaft of the motor is rotated to rotate the impeller whose rotation produces an upward air flow that is forced to pass through air vents located at the top of the air cushion table to push a ball located above the air cushion table, so that the ball is moved above the air cushion table in an irregular manner, thereby providing an amusement playing effect for players. However, the air flow produced by the impeller is not large enough to push the ball to move at a higher speed, thereby greatly decreasing the playing effect for the players. In addition, the motor produces vibration and noise during operation. Further, the impeller produces a relatively smaller air flow, thereby decreasing the heat dissipation effect of the conventional motor-operated fan.

SUMMARY OF THE INVENTION

In accordance with the present invention, there is provided a motor-operated fan, comprising: a housing; a motor secured in the housing; an impeller rotatably mounted on the housing and rotated by the motor, wherein: the impeller has a plurality of blades and a plurality of auxiliary blades to produce a larger air flow when the impeller is rotated.

The primary objective of the present invention is to provide a motor-operated fan for an air cushion table to provide an amusement effect for players.

Another objective of the present invention is to provide a motor-operated fan, wherein the impeller has a plurality of blades and a plurality of auxiliary blades to produce a larger air flow when the impeller is rotated so as to push a ball located above the air cushion table, so that the ball is moved above the air cushion table in an irregular manner at a higher speed, thereby providing an amusement playing effect for players.

A further objective of the present invention is to provide a motor-operated fan, wherein the motor is hidden in the housing completely, thereby greatly reducing vibration and noise of the motor-operated fan.

A further objective of the present invention is to provide a motor-operated fan, wherein the impeller has a plurality of blades and a plurality of auxiliary blades to produce a larger air flow, thereby enhancing the heat dissipation effect of the motor-operated fan.

Further benefits and advantages of the present invention will become apparent after a careful reading of the detailed description with appropriate reference to the accompanying drawings.

DETAILED DESCRIPTION OF THE INVENTION

Figure 1:
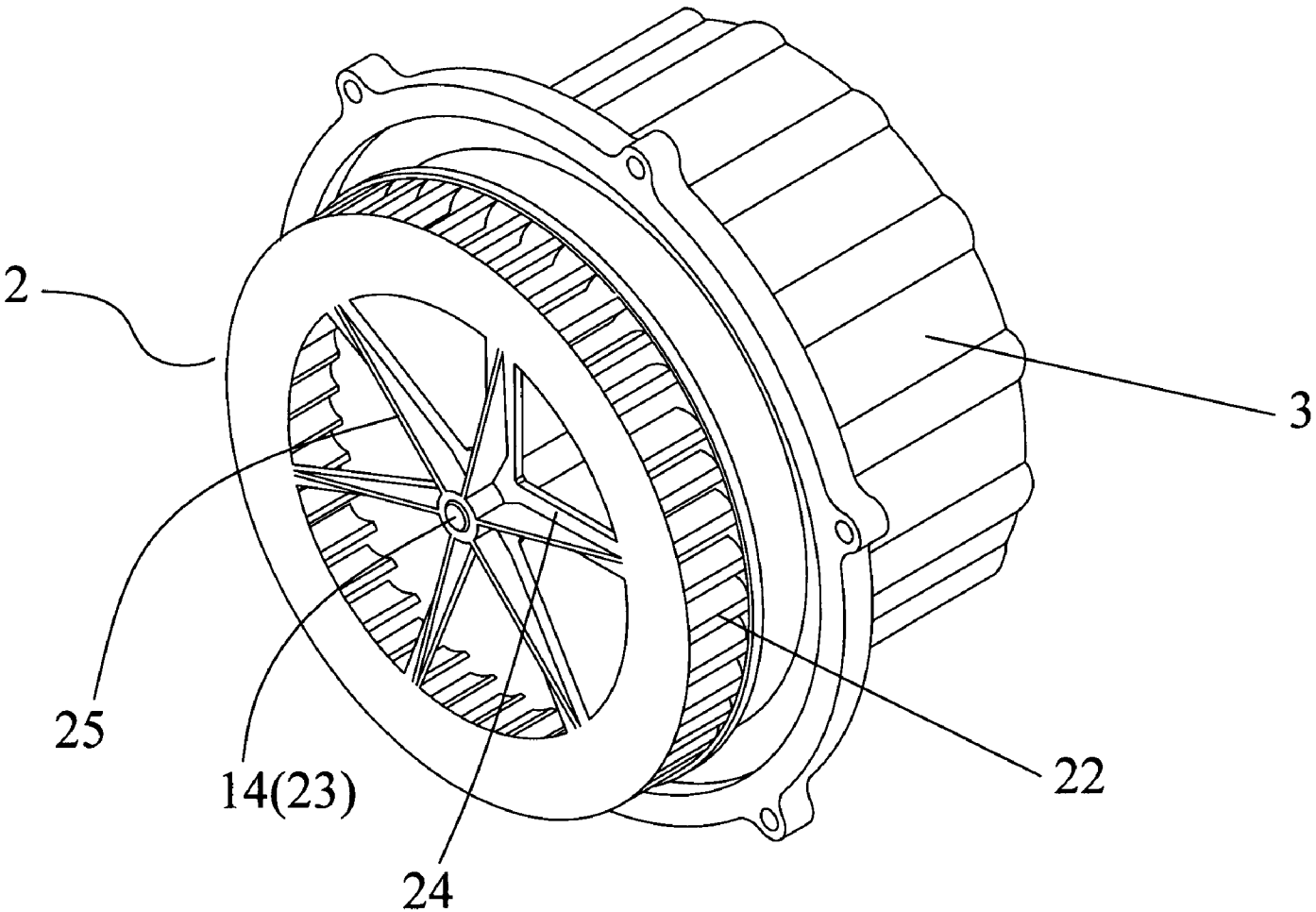
FIG. 1 is a perspective view of a motor-operated fan in accordance with the preferred embodiment of the present invention.
Figure 2:
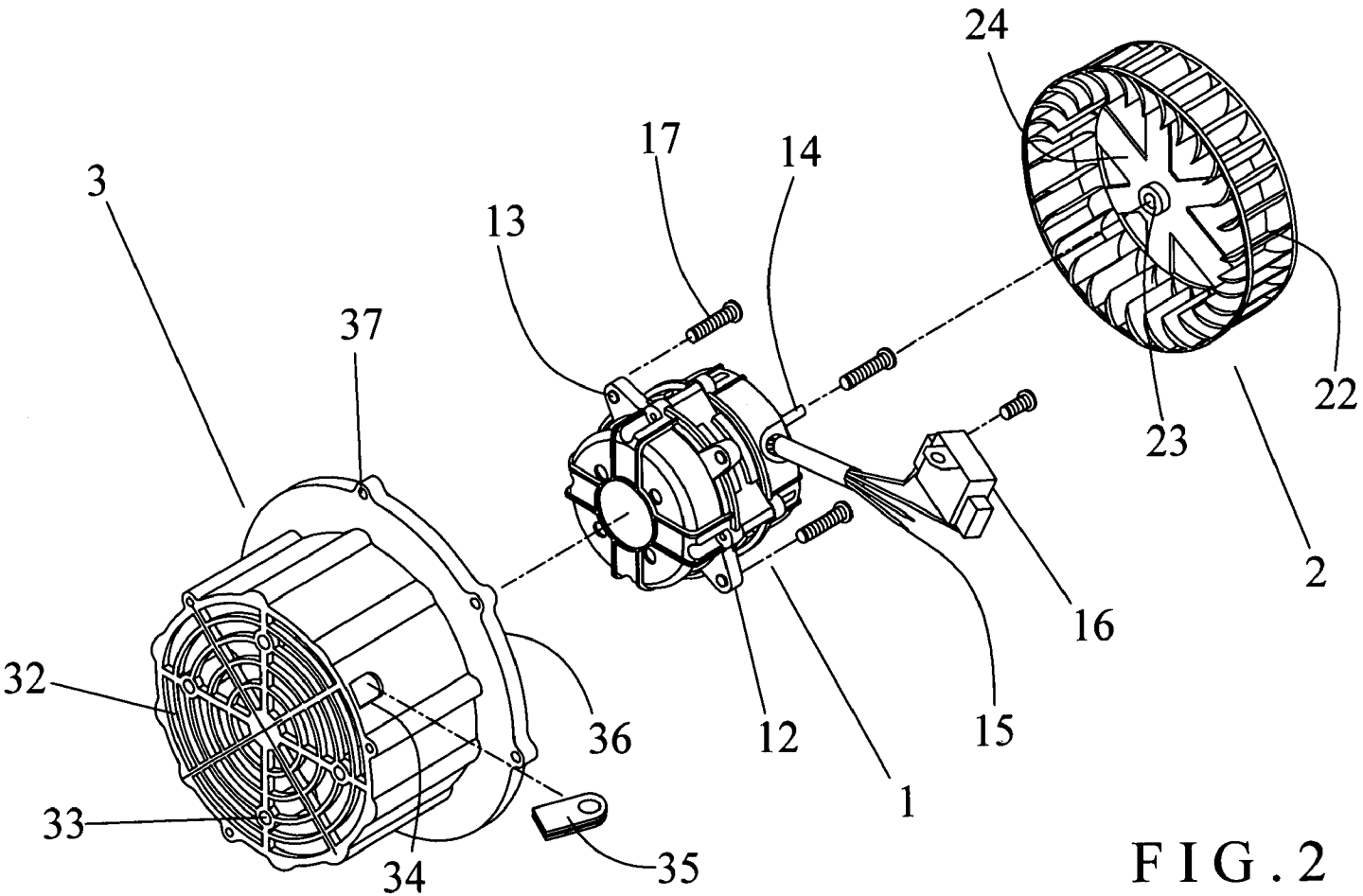
FIG. 2 is an exploded perspective view of the motor-operated fan as shown in FIG. 1.

Referring to the drawings and initially to FIGS. 1 and 2, a motor-operated fan in accordance with the preferred embodiment of the present invention comprises a housing 3, a motor 1 secured in the housing 3, and an impeller 2 rotatably mounted on the housing 3 and rotated by the motor 1.

Figure 3:
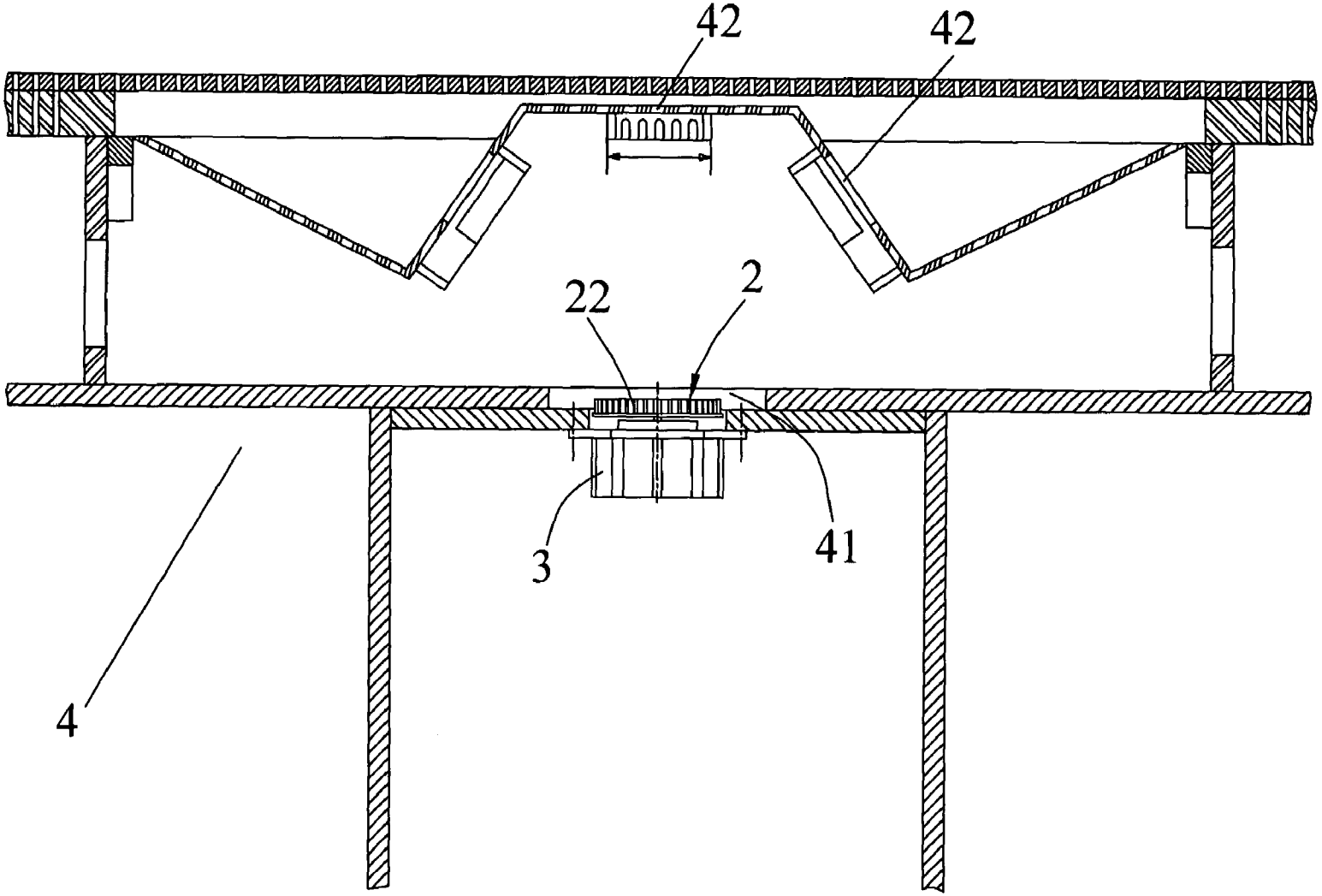
FIG. 3 is a plan cross-sectional assembly view showing the motor-operated fan being mounted to an air cushion table.

The housing 3 is a circular recessed body and has a closed wall formed with a net-shaped plate 32 and an opened wall formed with a radially outward extended annular flange 36 having a plurality of mounting holes 37 for mounting the housing 3 to an air cushion table 4 as shown in FIG. 3. The net-shaped plate 32 of the housing 3 is arranged in a radiating manner and has a plurality of screw bores 33. The housing 3 has a peripheral wall formed with a U-shaped slot 34.

The motor 1 has a central portion provided with a rotation shaft 14. The motor 1 has a peripheral wall provided with a plurality of fixing ears 12 each formed with a through hole 13, and the motor-operated fan further comprises a plurality of screw members 17 each extended through the through hole 13 of a respective one of the fixing ears 12 of the motor 1 and each screwed into a respective one of the screw bores 33 of the net-shaped plate 32 of the housing 3, so that the motor 1 is secured in the housing 3. In addition, the motor 1 is hidden in the housing 3 completely. The motor 1 has a side provided with at least one electric wire 15 extended through and protruded outward the U-shaped slot 34 of the housing 3 and connected to a power supply (not shown) to supply an electric power to the motor 1, and a capacitor 16 connected to the electric wire 15. If necessary, a cover plate 35 is mounted in an inner edge of the U-shaped slot 34 of the housing 3 to reduce the opening area of the U-shaped slot 34 of the housing 3.

The impeller 2 is a circular recessed body and has a closed wall formed with a plurality of ribs 24. Each of the ribs 24 of the impeller 2 is provided with an outward extended auxiliary blade 25 perpendicular to the respective rib 24 to produce a larger air flow when the impeller 2 is rotated. The ribs 24 of the impeller 2 are arranged in a radiating manner and each of the ribs 24 of the impeller 2 is extended from a central portion of the impeller 2 to a periphery of the impeller 2. The closed wall of the impeller 2 has a central portion formed with a fixing hole 23 fixed on the rotation shaft 14 of the motor 1 to rotate therewith. The impeller 2 has a peripheral wall perpendicular to the closed wall and provided with a plurality of blades 22 protruding outward from the housing 3.

As shown in FIG. 3, the motor-operated fan is mounted in a mounting hole 41 located at the bottom of an air cushion table 4.

In operation, referring to FIGS. 1–3, when the motor 1 is operated, the rotation shaft 14 of the motor 1 is rotated to rotate the impeller 2 whose rotation produces an upward air flow that is forced to pass through air vents 42 located at the top of the air cushion table 4 to push a ball (not shown) located above the air cushion table 4, so that the ball is moved above the air cushion table 4 in an irregular manner, thereby providing an amusement playing effect for players.

Accordingly, the impeller 2 has a plurality of blades 22 and a plurality of auxiliary blades 25 to produce a larger air flow when the impeller 2 is rotated so as to push a ball located above the air cushion table 4, so that the ball is moved above the air cushion table 4 in an irregular manner at a higher speed, thereby providing an amusement playing effect for players. In addition, the motor 1 is hidden in the housing 3 completely, thereby greatly reducing vibration and noise of the motor-operated fan. Further, the impeller 2 has a plurality of blades 22 and a plurality of auxiliary blades 25 to produce a larger air flow, thereby enhancing the heat dissipation effect of the motor-operated fan.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A motor-operated fan, comprising:

a housing;

a motor secured in the housing;

an impeller rotatably mounted on the housing and rotated by the motor, wherein:

the impeller has a plurality of blades and a plurality of auxiliary blades to produce a larger air flow when the impeller is rotated;

the housing has a closed wall formed with a net-shaped plate having has a plurality of screw bores, the motor has a peripheral wall provided with a plurality of fixing ears each formed with a through hole, and the motor-operated fan further comprises a plurality of screw members each extended through the through hole of a respective one of the fixing ears of the motor and each screwed into a respective one of the screw bores of the net-shaped plate of the housing, so that the motor is secured in the housing.

2. The motor-operated fan in accordance with claim 1, wherein the housing is a circular recessed body.

3. The motor-operated fan in accordance with claim 1, wherein the net-shaped plate of the housing is arranged in a radiating manner.

4. The motor-operated fan in accordance with claim 1, wherein the motor is hidden in the housing completely.

5. The motor-operated fan in accordance with claim 1, wherein the housing has an opened wall formed with a radially outward extended annular flange having a plurality of mounting holes.

6. The motor-operated fan in accordance with claim 1, wherein the impeller is a circular recessed body.

7. The motor-operated fan in accordance with claim 1, wherein the motor has a central portion provided with a rotation shaft, and the impeller has a closed wall having a central portion formed with a fixing hole fixed on the rotation shaft of the motor to rotate therewith.

8. A motor-operated fan, comprising:

a housing;

a motor secured in the housing;

an impeller rotatably mounted on the housing and rotated by the motor, wherein:

the impeller has a plurality of blades and a plurality of auxiliary blades to produce a larger air flow when the impeller is rotated;

the impeller has a closed wall formed with a plurality of ribs, and each of the auxiliary blades is mounted on and perpendicular to of a respective one of the ribs;

the impeller has a peripheral wall perpendicular to the closed wall, and each of the blades is mounted on the peripheral wall of the impeller.

9. The motor-operated fan in accordance with claim 8, wherein each of the auxiliary blades is extended outward from a respective one of the ribs.

10. The motor-operated fan in accordance with claim 8, wherein the ribs of the impeller are arranged in a radiating manner.

11. The motor-operated fan in accordance with claim 8, wherein the each of the ribs of the impeller is extended from a central portion of the impeller to a periphery of the impeller.

12. The motor-operated fan in accordance with claim 1, wherein each of the blades of the impeller are protruding outward from the housing.

13. A motor-operated fan, comprising:

a housing;

a motor secured in the housing;

an impeller rotatably mounted on the housing and rotated by the motor, wherein:

the impeller has a plurality of blades and a plurality of auxiliary blades to produce a larger airflow when the impeller is rotated;

the housing has a peripheral wall formed with a U-shaped slot, and the motor has a side provided with at least one electric wire extended through and protruded outward the U-shaped slot of the housing, and a capacitor connected to the electric wire.

14. The motor-operated fan in accordance with claim 13, further comprising a cover plate mounted in an inner edge of the U-shaped slot of the housing to reduce the opening area of the U-shaped slot of the housing.

* * * * *